US008353506B2

(12) United States Patent
Yuan et al.

(10) Patent No.: US 8,353,506 B2
(45) Date of Patent: Jan. 15, 2013

(54) EQUIPMENT FOR MAKING AN ALBUM CORE AUTOMATICALLY

(75) Inventors: Weijun Yuan, Guangzhou (CN); Xiaoqiang Zhang, Guangzhou (CN); Yiqiang Deng, Guangzhou (CN)

(73) Assignee: Imetto Digital Imaging Technology Co., Ltd., Guangdong (CN)

( * ) Notice: Subject to any disclaimer, the term of this patent is extended or adjusted under 35 U.S.C. 154(b) by 0 days.

(21) Appl. No.: 12/812,924

(22) PCT Filed: Aug. 6, 2008

(86) PCT No.: PCT/CN2008/071895

§ 371 (c)(1), (2), (4) Date: Aug. 9, 2010

(87) PCT Pub. No.: WO2010/000115

PCT Pub. Date: Jan. 7, 2010

(65) Prior Publication Data

US 2011/0097179 A1 Apr. 28, 2011

(30) Foreign Application Priority Data

Jul. 2, 2008 (CN) ..... 2008 2 0050155 U

(51) Int. Cl.
*B65H 37/04* (2006.01)

(52) U.S. Cl. ..... 270/58.07; 270/32; 270/45; 270/52.18

(58) Field of Classification Search ..... 270/32, 270/45, 51, 52.18, 58.08; 412/4, 8, 14, 18, 412/25, 37

See application file for complete search history.

(56) References Cited

U.S. PATENT DOCUMENTS

| | | | | |
|---|---|---|---|---|
| 5,702,219 | A | 12/1997 | Hattori | |
| 6,394,730 | B1 * | 5/2002 | Manico et al. | 412/9 |
| 6,435,562 | B1 | 8/2002 | McIntyre et al. | |
| 2005/0253321 | A1 | 11/2005 | Kimura et al. | |
| 2008/0049247 | A1 * | 2/2008 | Asai et al. | 358/1.15 |
| 2008/0267735 | A1 * | 10/2008 | Hama | 412/37 |
| 2009/0062096 | A1 * | 3/2009 | Sasahara | 493/396 |

FOREIGN PATENT DOCUMENTS

| | | | |
|---|---|---|---|
| CN | 2147091 | Y | 11/1993 |
| CN | 1158300 | A | 9/1997 |
| CN | 1297819 | A | 6/2001 |
| CN | 1665687 | A | 9/2005 |
| JP | 07-025183 | A | 1/1995 |
| JP | 07-223386 | A | 8/1995 |

* cited by examiner

*Primary Examiner* — Leslie A Nicholson, III
(74) *Attorney, Agent, or Firm* — Sughrue Mion, PLLC

(57) ABSTRACT

The present utility model relates to an equipment for making an album core automatically, which comprises automatic feeding mechanisms for feeding an album paper and an interlayer, a creasing mechanism for creasing the middle of the album paper to form a crease, a folding mechanism for folding the album paper along the crease and a pasting mechanism for pasting the album or the interlayer by coating glue, wherein the automatic feeding mechanisms include an album paper feeding mechanism, an interlayer feeding mechanism and a control mechanism connected to the two feeding mechanisms. The equipment in the utility model has higher automaticity and can select the kinds of album papers freely.

6 Claims, 1 Drawing Sheet

EQUIPMENT FOR MAKING AN ALBUM CORE AUTOMATICALLY

BACKGROUND OF THE INVENTION

1. Technical Field

The present utility model relates to an equipment for making an album core, and more especially, to an equipment for making an album core automatically.

2. Description of Related Art

Albums are now often made manually or by a semi-auto machines. The machine for automatically pasting core by means of hot melt adhesive in the prior art boasts the advantages of high automation degree, fast making speed, favorable accuracy of middle-seam alignment and good pasting effect, but also has following disadvantages: the creasing and folding module is realized by an additional machine, full-flow automation is not achieved, and it is designed to fit for continuous developing and printing, namely, the whole film of album paper is required to be developed and printed, so the machine has poor applicability due to incapability of being used in other type of developing and printing.

Moreover, there is a common defect among most equipment for making album, that is, the equipment is fixed with or without an interlayer, incapable of being changed flexibly at the customer's desire.

BRIEF SUMMARY OF THE INVENTION

In view of the disadvantages in the prior art, the present utility model aims at providing an equipment for making album core automatically with high automation degree and flexible choices.

To realize the purpose above, the present utility model provides the technical solution below: an equipment for making an album core automatically, comprising automatic feeding mechanisms connected in proper order for feeding an album paper and an interlayer, a creasing mechanism for creasing the middle of the album paper to form a crease, a folding mechanism for folding the album paper along the crease and a pasting mechanism for pasting the album or the interlayer by coating glue, wherein the automatic feeding mechanisms include an album paper feeding mechanism, an interlayer feeding mechanism and a control mechanism connected to the two feeding mechanisms.

Both the album paper feeding mechanism and the interlayer feeding mechanism are mainly composed of paper feeding slot portion and paper carrying portion connected in proper order; the interlayer feeding mechanism includes one or multiple paper feeding slot portions for placing the interlayer; the album paper feeding mechanism and the interlayer feeding mechanism further include a paging mechanism between the paper feeding slot portion and paper carrying portion.

The folding mechanism mainly consists of paper feeding roller mechanism for drawing and rolling the middle crease location of album paper; the paper feeding roller mechanism is composed of two rollers interacting with each other.

The pasting mechanism includes an absorption cylinder connected with the folding mechanism, a glue applying mechanism set on one side of the absorption cylinder, a platform beneath the absorption cylinder, and a driving mechanism connected with the absorption cylinder and the platform capable of moving up and down; the absorption cylinder consists of the absorption mouth for absorbing the album paper or interlayer, a vacuum pipe connected with the absorption mouth and an evacuation system connected with the vacuum pipe.

The creasing mechanism includes a pressing mechanism and a detecting device for measuring the album paper length.

Compared with the prior art, the present utility model improves the conventional album making equipment, adopts double feeding mechanisms in automatic feeding mechanism, namely album paper feeding mechanism and interlayer feeding mechanism, and uses the control system to perform determination and selection of one feeding structure, so as to make an album with or without interlayer according to the customer's demand, in this way, realizing automatic control in the whole process, removing the defect requiring manual operation for adding interlayer or incapable of flexibly changing between adding or reducing the interlayer, thus improving the automation degree and production efficiency of album making process.

DETAILED DESCRIPTION OF THE INVENTION

The present utility model is further detailed in combination with the drawings.

Figure 1:
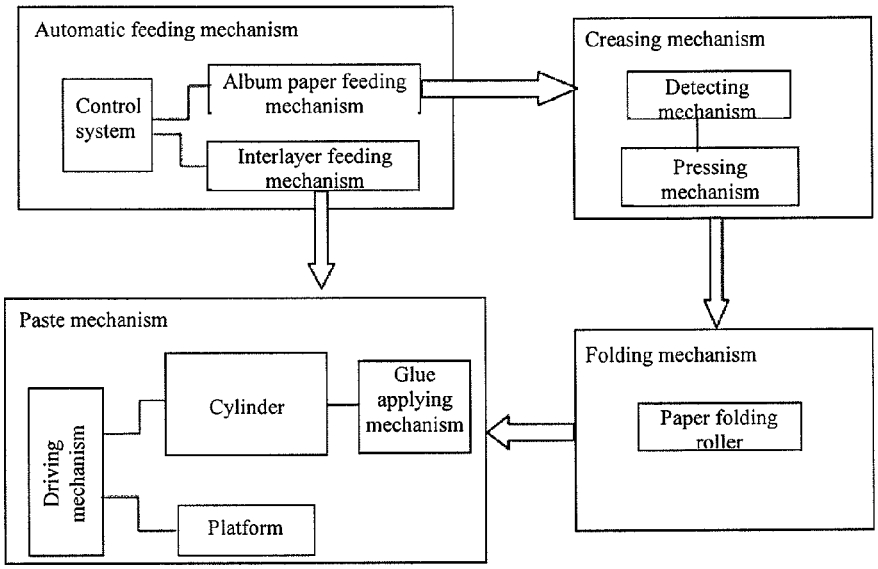
FIG. 1 is the block diagram of the equipment for making an album core automatically in the present utility model.
Figure 2:
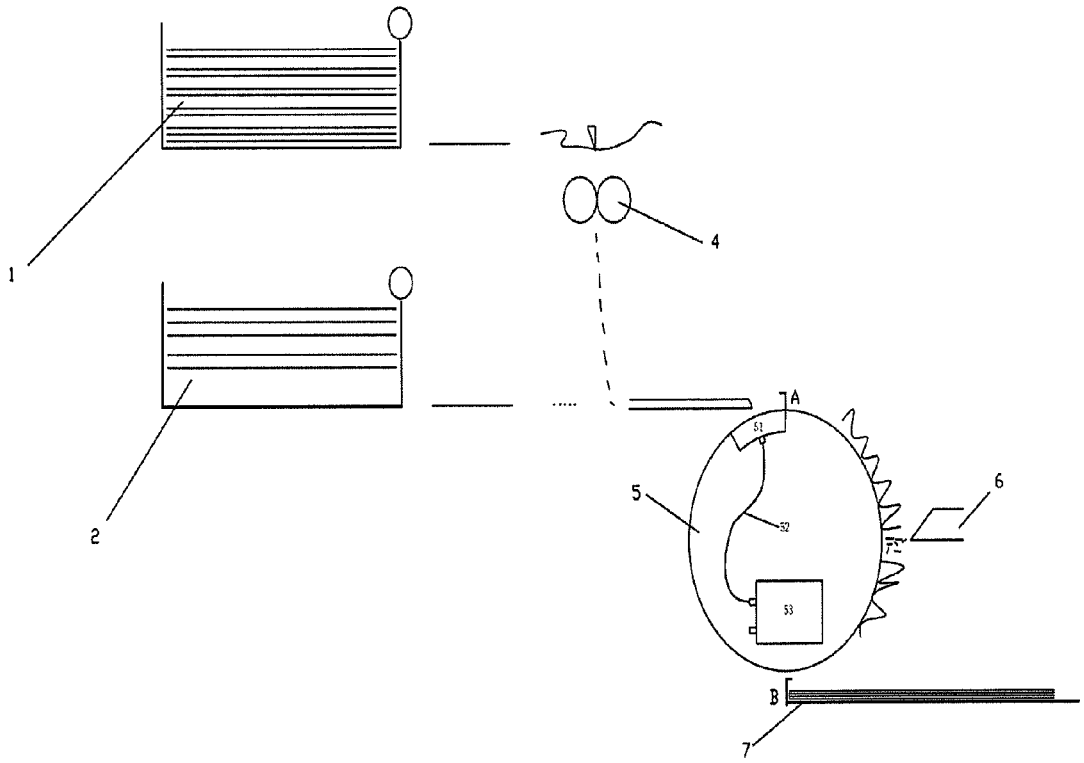
FIG. 2 is the schematic view of partial structure of the equipment for making an album core automatically in the present utility model.

As shown in FIGS. 1 and 2, an equipment for making an album core automatically, comprising automatic feeding mechanisms connected in proper order for feeding an album paper and an interlayer, a folding mechanism for folding the album paper along the middle line of the album paper and a pasting mechanism for pasting the album or the interlayer by coating glue, wherein the automatic feeding mechanisms include an album paper feeding mechanism 1, an interlayer feeding mechanism 2 and a control mechanism connected to the feeding mechanisms, the control system is set as desired or according to the program and automatically determines which one feeding mechanism shall be selected according to album type demand. When it is required to make an album without the interlayer, the control system keeps controlling the action of album paper feeding mechanism 1, but the interlayer feeding mechanism 2 fails to work, in this way to complete the album paper feeding; when it is required to make an album with the interlayer, the control system alternately controls the actions of the album paper feeding mechanism 1 and the interlayer feeding mechanism 2, thus to complete the album paper and interlayer feeding actions in turn.

Both the album paper feeding mechanism 1 and the interlayer feeding mechanism 2 are mainly composed of paper feeding slot portion for placing, positioning the album paper or interlayer, and paper carrying portion for transferring album paper or interlayer to the creasing mechanism. The album paper feeding mechanism 1 and the interlayer feeding mechanism 2 further include a paging mechanism between the paper feeding slot portion and paper carrying portion, wherein the album paper is placed in the album paper feeding slot portion and the interlayer is placed in the interlayer feeding slot portion; multiple pieces of album paper can be laid in the album paper feeding slot portion from top to bottom, thus the album paper can be pulled out by pages by means of the paging mechanism on the album paper feeding mechanism 1 when the album paper is required according to system need; similar to the album paper feeding mechanism 1, multiple interlayers can be laid on the interlayer feeding mechanism 2 in the order from top to bottom, thus the interlayer can be pulled out by pieces by means of the paging mechanism on the interlayer feeding mechanism 2 when the interlayer is required according to system need. The interlayer feeding mechanism further includes one or multiple paper feeding slot portions for placing the interlayer. When several feeding slot portions are provided, the interlayers made of the same materials or different materials can be placed on the feeding slot portions. When an interlay with larger thickness or special thickness is required for an album, limited by the design parameters of the pasting mechanism of the equipment, it is required to transfer the interlayers with different thicknesses or the same thickness made of same materials on the multiple feeding slot portions into the pasting mechanism so as to make an album of the type conforming to design requirements. In addition, interlayers made of different materials can be put on the multiple feeding slot portions and different feeding slot portions can be selected according to the need so as to make an album with interlayers of different types.

The creasing mechanism includes a pressing mechanism and a detecting device for measuring the album paper length. The detecting device automatically calculates the length of the album paper and transfers the middle location of the album paper to the location right below the pressing mechanism for pressing in order to complete the creasing of the album paper.

The folding mechanism mainly consists of paper feeding roller mechanism 4 for drawing and rolling the middle crease location of album paper; the paper feeding roller mechanism 4 is composed of two rollers interacting with each other. During folding, the middle line of album paper shall be oriented first. When the middle crease of album paper is just in the feeding location of two rollers, since the crease location is lower than the entire plane of album paper, the roller will fold the whole album paper according to the crease to put into two rollers for rolling.

The pasting mechanism includes an absorption cylinder 5 connected with the folding mechanism, a glue applying mechanism 6 set on one side of the absorption cylinder 5, a platform 7 beneath the absorption cylinder 5, and a driving mechanism connected with the absorption cylinder 5 and the platform 7 capable of moving up and down; the absorption cylinder 5 consists of the absorption mouth 51 for absorbing the album paper or interlayer, a vacuum pipe 52 connected with the absorption mouth 51 and an evacuation system 53 connected with the vacuum pipe 52.

When the absorption cylinder 5 is up to the peak point, album paper or interlayer is fed into the absorption mouth 51 by alignment with the middle crease. With the rotation of the absorption cylinder 5, album paper or interlayer turns to the location of the glue applying mechanism 6, then the glue applying mechanism 6 applies glue onto album or interlayer. However, when the absorption cylinder 5 gets at the lowest point, the platform is raised under the action of the driving mechanism, and the linear speed of the cylinder 5 is consistent with the moving speed of the platform 7, so as to guarantee that the album paper with or without interlayer is rolled and pasted by the platform 7 and the cylinder 5, thus making the glue surface of current piece of album paper or interlayer bonded with the non-coating surface of the last piece of album paper or interlayer. Repeat the steps above to complete the making of the album core. For making album with interlayer, the equipment automatically sends out an interlayer from the interlayer feeding mechanism and paste an interlayer between two piece of album paper. Repeat such shifting action to complete the making of album core with interlayer automatically.

What is claimed is:

1. An equipment for making an album core automatically, characterized in that, comprising automatic feeding mechanisms connected in proper order for feeding an album paper and an interlayer, a creasing mechanism for creasing the middle of the album paper to form a crease, a folding mechanism for folding the album paper along the crease and a pasting mechanism for pasting the album or the interlayer by coating glue, wherein the automatic feeding mechanisms include an album paper feeding mechanism, an interlayer feeding mechanism, and a control mechanism connected to the two feeding mechanisms and operated in such a way that when the equipment makes an album with interlayers, the interlayers and the album paper are alternatively fed to the pasting mechanism.

2. The equipment for making an album core automatically according to claim 1, characterized in that the folding mechanism mainly consists of paper feeding roller mechanism for drawing and rolling the middle crease location of album paper.

3. The equipment for making an album core automatically according to claim 2, characterized in that the paper feeding roller mechanism is composed of two rollers interacting with each other.

4. The equipment for making an album core automatically according to claim 1, characterized in that the pasting mechanism includes an absorption cylinder connected with the folding mechanism, a glue applying mechanism set on one side of the absorption cylinder, a platform beneath the absorption cylinder, and a driving mechanism connected with the absorption cylinder and the platform capable of moving up and down.

5. The equipment for making an album core automatically according to claim 4, characterized in that the absorption cylinder consists of an absorption mouth for absorbing the album paper or interlayer, a vacuum pipe connected with the absorption mouth and an evacuation system connected with the vacuum pipe.

6. The equipment for making an album core automatically according to claim 1, characterized in that the creasing mechanism includes a pressing mechanism and a detecting device for measuring the album paper length.

* * * * *